US007600445B2

(12) United States Patent
Dubay

(10) Patent No.: US 7,600,445 B2
(45) Date of Patent: Oct. 13, 2009

(54) UNIVERSAL SLIDE ASSEMBLY FOR MOLDING AND CASTING SYSTEM

(76) Inventor: Richard L. Dubay, 14800 James Rd., Rogers, MN (US) 55374

( * ) Notice: Subject to any disclaimer, the term of this patent is extended or adjusted under 35 U.S.C. 154(b) by 765 days.

(21) Appl. No.: 11/008,493

(22) Filed: Dec. 9, 2004

(65) Prior Publication Data

US 2005/0121166 A1 Jun. 9, 2005

Related U.S. Application Data

(60) Provisional application No. 60/528,265, filed on Dec. 9, 2003.

(51) Int. Cl.
*F16H 25/08* (2006.01)

(52) U.S. Cl. ..... 74/53

(58) Field of Classification Search ..... 74/53, 74/527, 567, 569; 169/137, 302, 340, 341, 169/342, 344; 425/556, 577
See application file for complete search history.

(56) References Cited

U.S. PATENT DOCUMENTS 3,421,730 A * 1/1969 Dransfield et al. ..... 249/142
5,533,564 A 7/1996 Alberola et al.
5,690,159 A 11/1997 Mizukusa
6,093,015 A * 7/2000 Navarre ..... 425/556
6,220,114 B1 * 4/2001 Ray ..... 74/527
6,431,254 B2 8/2002 Dittrich
6,443,723 B1 * 9/2002 Buttigieg ..... 425/214
6,591,893 B1 7/2003 Ratte et al.
6,659,760 B2 * 12/2003 Liao et al. ..... 425/577
2004/0247726 A1 * 12/2004 Takemoto et al. ..... 425/190
2005/0098295 A1 * 5/2005 Dubay ..... 164/312

OTHER PUBLICATIONS

Versa-Slide (Micro) Hardened & Ground catalog, pp. 4-1 and 4-2.
Progressive Components catalog, pp. C-16, C-19-C30.

* cited by examiner

*Primary Examiner*—Vicky A Johnson
(74) *Attorney, Agent, or Firm*—Kinney & Lange, P.A.

(57) ABSTRACT

The present invention is a universal slide assembly for molding or casting systems used to introduce complex designs to moldings and castings, which is cost effective, easy to install, and easy to operate, and includes a base, a slide, and a retention means. The base is directly insertable into a die half for immediate use without requiring the slide to be individually designed or adapted to a particular die half. The retention means provides a means for retaining the slide in a retracted position, preventing the slide from accidentally moving.

24 Claims, 9 Drawing Sheets

UNIVERSAL SLIDE ASSEMBLY FOR MOLDING AND CASTING SYSTEM

CROSS-REFERENCE TO RELATED APPLICATION(S)

This application is related to and a continuation-in-part of U.S. patent application Ser. No. 10/646,094, filed on Aug. 22, 2003, which is based upon U.S. Provisional Patent Application No. 60/413,992, filed on Sep. 26, 2002, both entitled "Universal Slide Assembly for Molding and Casting Systems", and U.S. Provisional Patent Application No. 60/528,265 filed on Dec. 9, 2003, entitled "Universal Slide Assembly for Molding and Casting Systems", which are herein incorporated by reference.

BACKGROUND OF THE INVENTION

The present invention relates to injection molding and die casting processes. In particular, the present invention relates to injection molding and die casting slide systems.

Injection molding and die casting are manufacturing processes for producing a multitude of shapes and designs for plastic and metal products. Such processes generally incorporate two-component systems. The two components are the fixed-die half and the movable-die half. The fixed-die half is secured to the apparatus and contains a portion of a cavity or core where plastic or molten metal is injected into for curing or solidification.

In contrast, the movable-die half is capable of moving and contains the other portion of the core where plastic or molten metal is injected into for curing or solidification. During a molding or casting cycle, the movable-die half moves towards and clamps to the fixed-die half so that the core is completely enclosed by the two halves. Once the core is sealed, the plastic or molten metal is injected to cure or solidify. After the cycle is completed, the movable-die half retracts away from the fixed-die half, allowing removal of the molding or casting.

Such two-component systems may also incorporate slides mounted to the movable-die half to create key aspects of the moldings or castings that the movable-die half and the fixed-die half are incapable of producing. For example, a slide may contain a pin that extends into the core when the slide is positioned at the core. When the injected material cures or solidifies, the slide retracts, pulling the pin out of the molding or casting. This results in a hole within the molding or casting.

For more complex moldings and castings, multiple slides can be incorporated. The slides are positioned around a central core of the movable-die half. When a molding or casting cycle begins, the slides move forward and create a perimeter around the core. The movable-die half also moves towards and clamps to the fixed-die half so that the core is completely enclosed by the two halves and the slides. Once the core is sealed, the plastic or molten metal is injected to cure or solidify. After the cycle is completed, the movable-die half and the slides retract away from the core, allowing removal of the molding or casting.

Currently in the industry, slides for an injection molding or die casting apparatus have to be individually tailored to the fixed-die half or movable-die half where the slide is mounted. The pertinent fixed-die half or movable-die half contains tracks that a particular slide must fit into. Such individualization of slides is expensive and time-consuming. This can be especially troublesome if a particular slide is defective or damaged during molding or casting cycles. Another identical slide must be obtained and installed before the process can continue. In addition, slides must be carefully installed into the tracks of the pertinent fixed-die halves or movable-die halves in order to ensure proper alignment when positioned at the core. This is also very time consuming and tedious, taking up time that could otherwise be used for operating the system. As such, there remains a need in the industry for a slide system that is easy to install and replace, while also being accurate and reliable in use with molding or casting cycles.

BRIEF SUMMARY OF THE INVENTION

The present invention is a universal slide assembly for a molding or casting system used to introduce complex designs to moldings and castings. The present invention comprises a base, a slide insertable into the base such that the slide is movable relative to the base, and a pair of retention pins for retaining the slide in a retracted position. The base is insertable into a die half for immediate use without requiring the slide to be individually designed or adapted to a particular die half. The retention pins engage the slide to retain the slide in a retracted position when the die halves are open, and disengage from the slide when the die halves close to allow the slide to move forward towards a mold core.

DETAILED DESCRIPTION

Figure 1:
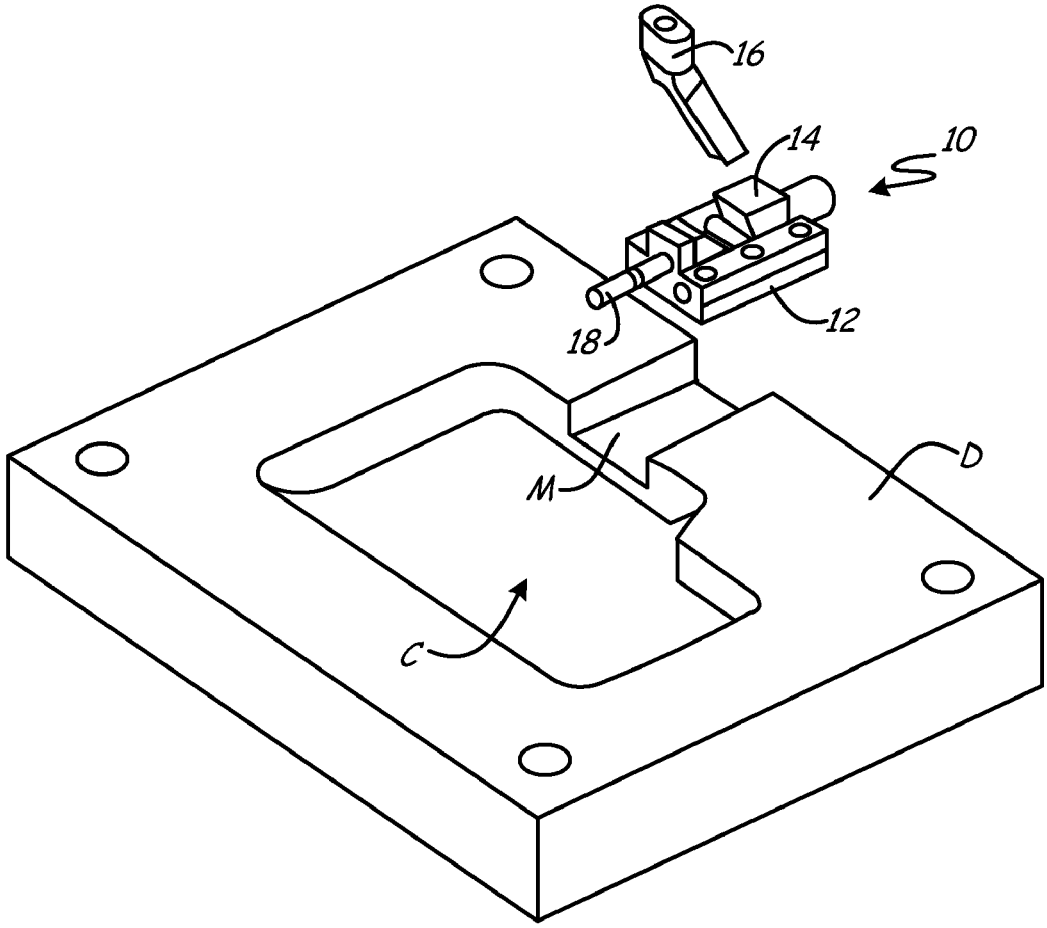
FIG. 1 is an exploded perspective view of the universal slide assembly of the present invention positioned above a die half.
Figure 2:
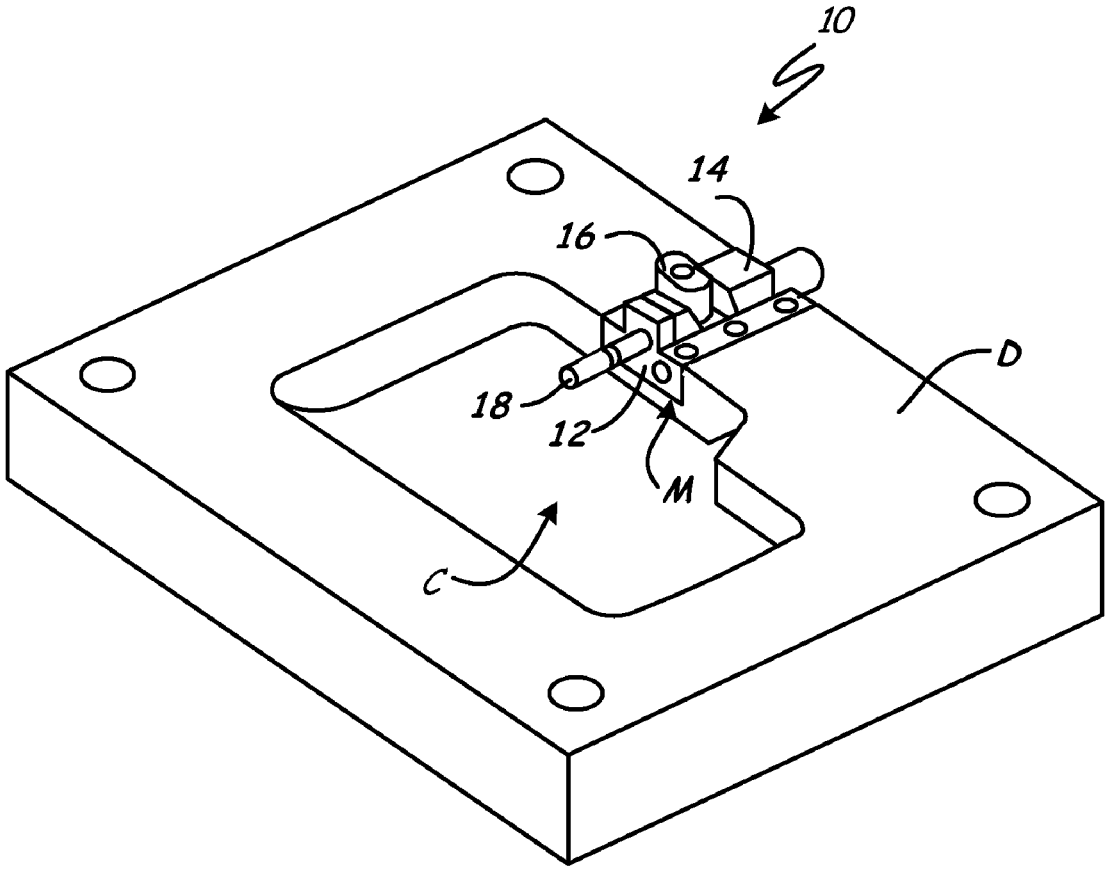
FIG. 2 is an exploded perspective view of the universal slide assembly of the present invention mounted to a die half.

FIGS. 1 and 2 are perspective views of universal slide assembly 10 and movable-die half D of a die block, illustrating the ease of use and installation of universal slide assembly 10. FIG. 1 is an exploded view that illustrates universal slide assembly 10 positioned above die half D. FIG. 2 illustrates universal slide assembly 10 mounted to die half D ready for use with an injection molding or a die casting process. Universal slide assembly 10 is a universal design that includes base 12, slide 14, cam lever 16, and pin 18. Die half D in FIGS. 1 and 2 is a movable-die half and includes core C and mounting detent M. Core C is a portion of the cavity or core in die half D where plastic or molten metal is injected for curing or solidification.

In addition to the components illustrated, FIGS. 1 and 2 also incorporate a fixed-die half (not shown), to which die half D is clamped, enclosing core C to create the complete molding or casting core. Alternatively, die half D may be a fixed-die half, in which case a movable-die half would clamp to die half D, enclosing core C to create the complete molding or casting core. As such, references to a movable-die half are only intended to be illustrative, and universal slide assembly 10 of the present invention is capable of being mounted to either a movable-die half or a fixed-die half.

Mounting detent M is an opening in die half D to core C and is where base 12 securely mounts to die half D, rendering base 12 immobile. In use, slide 14 inserts into base 12 so that slide 14 is mobile along base 12 for sliding towards, and retracting away from, core C. Herein, general references to slide 14 moving forward to a forward position relate to slide 14 sliding relative to base 12 in a direction towards core C of die half D. Correspondingly, general references to slide 14 retracting to a retracted position relate to slide 14 sliding relative to base 12 in a direction away from core C of die half D.

Once slide 14 is inserted into base 12, cam lever 16 is insertable from above through slide 14 and into base 12. As cam lever 16 is inserted through slide 14 and into base 12, slide 14 is forced to the forward position adjacent core C. When cam lever 16 is fully inserted though slide 14 and in base 12, slide 14 is securely locked with base 12 by cam lever 16, preventing slide 14 from retracting away from core C during a molding or casting cycle.

Pin 18 is connected to a front end of slide 14 and extends into core C when slide 14 is in the forward position. After the molding or casting process is completed, slide 14 retracts and pin 18 is pulled completely out of the solidified molding or casting, resulting in a hole within the molding or casting. Slide 14 may alternatively contain other conventional instruments and designs, as is known in the art.

The use of base 12 precludes the need to individually design or adapt slide 14 to be compatible with die half D. Slide 14 is completely entrained within and mobile with respect to base 12, allowing universal slide assembly 10 to be installed into many different movable-die halves without requiring slide 14 to be individually designed or adapted to a particular mounting detent M. As such, universal slide assembly 10 may be installed, exchanged, and replaced with minimal time and expense.

Figure 3:
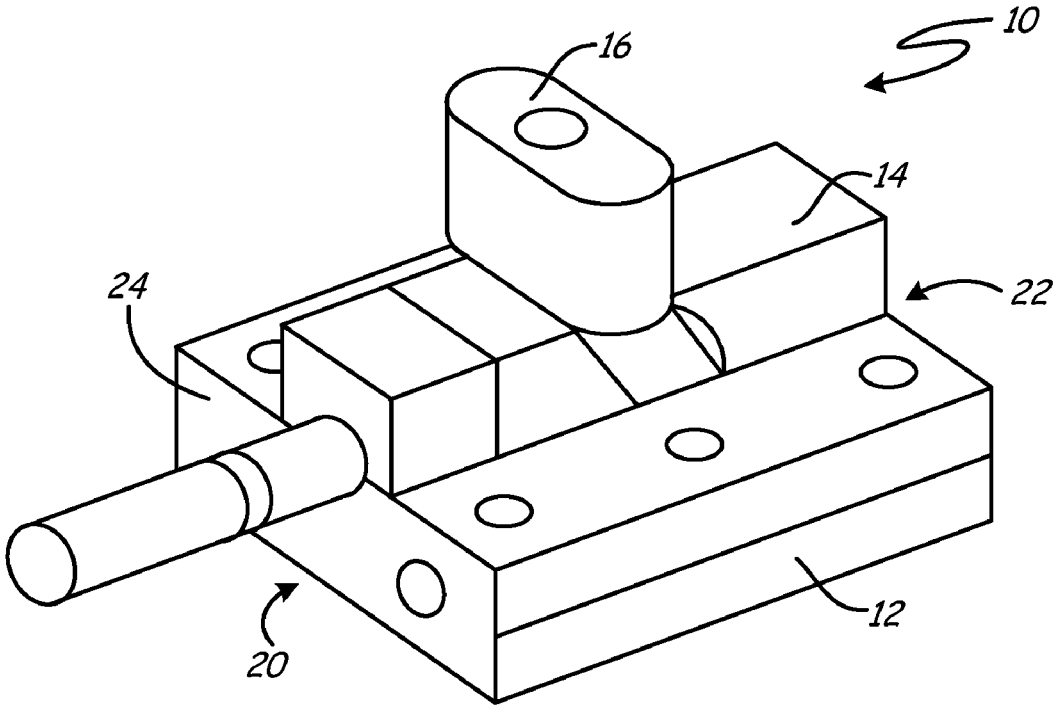
FIG. 3 is an enlarged view of the universal slide assembly of the present invention.

To better illustrate universal slide assembly 10 of the present invention, FIG. 3 is an enlarged view of universal slide assembly 10 in the forward position with cam lever 16 fully inserted through slide 14 and base 12. Universal slide assembly 10 has a front end 20 and a rear end 22 and generally comprises base 12, slide 14 mounted in base 12, cam lever 16, and face plate 24 at front end 20. Slide 14 is moveable along base 12 between front end 20 and rear end 22 of universal slide assembly 10.

Figure 4:
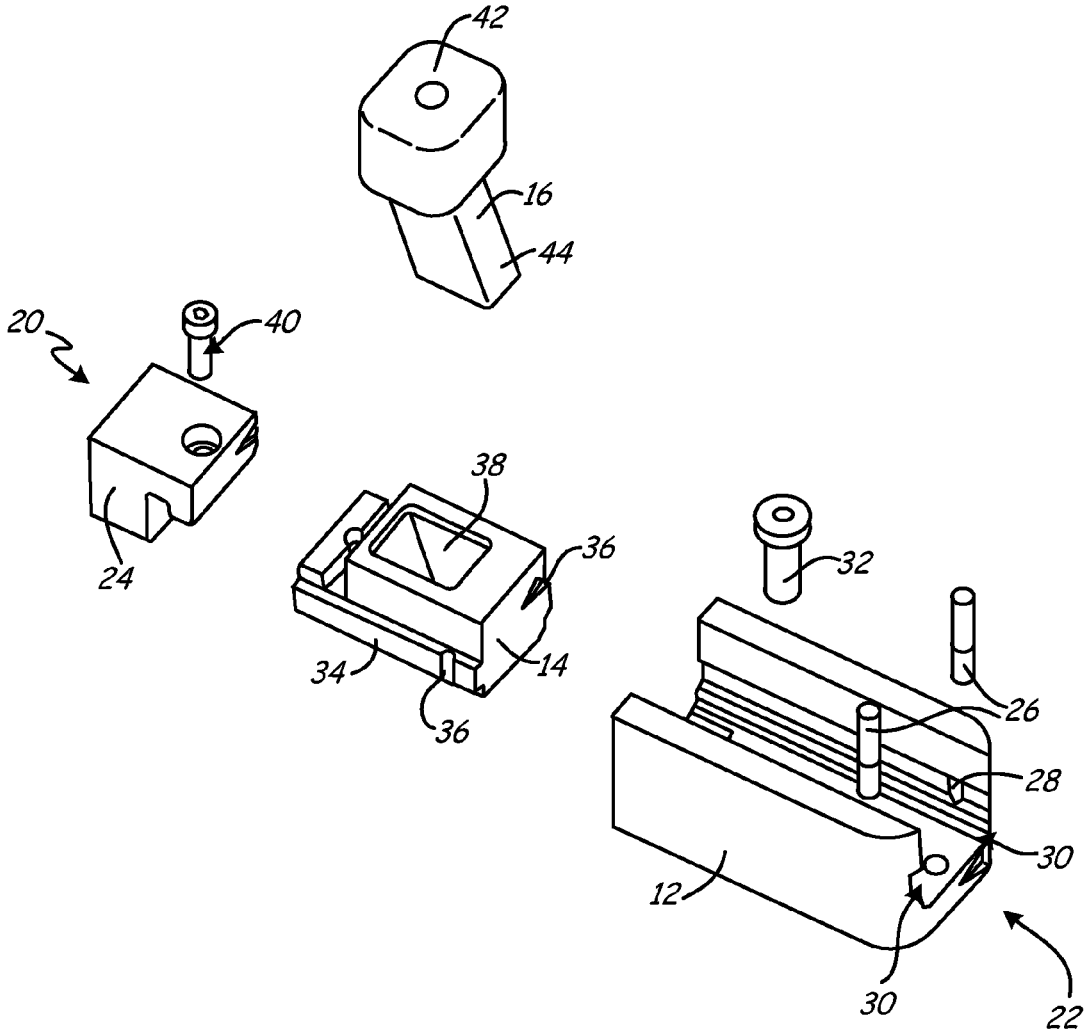
FIG. 4 is an exploded view of the universal slide assembly of the present invention.

FIG. 4 is an exploded view of universal slide assembly 10. Universal slide assembly 10 generally comprises base 12, retention pins 26, retention pin holes 28, tracks 30, screw 32, slide 14, rails 34, retention pin detents 36, detent 38, cam lever 16, face plate 24, and face plate bolt 40. Base 12 comprises retention pins 26, retention pin holes 28 for housing retention pins 26, tracks 30, and screw 32 for mounting base 24 to mounting detent M of die half D (shown in FIGS. 1 and 2). Retention pins 26 are mounted to base 12 at rear end 22 of universal slide assembly 10 in retention pin holes 28 and retain slide 14 in the retracted position so that the plastic or metal mold can be removed from core C (shown in FIGS. 1 and 2) without interference from face plate 24. Once the mold is removed from core C, retention pins 26 are disengaged from slide 14 and die half D closes.

Tracks 30 run laterally along internal side walls of base 12 and allow slide 14 to glide along base 12 between the forward and retracted positions. A portion of retention pin holes 28 intersect with track 30, exposing a portion of retention pins 26 to slide 14. This allows retention pins 26 to contact slide 14 at tracks 30 such that when slide 14 retracts to a certain position along base 12, retention pins 26 engage retention pin detents 26 of slide 14 and retain slide 14 in the retracted position.

Base 12 is mountable to a movable-die half of an injection molding or die casting apparatus, such as die half D, and is bolted into place at mounting detent M with screw 32.

Slide 14 comprises rails 34 for engaging tracks 30 of base 12, retention pin detents 36 for engaging retention pins 26, and detent 38 for accepting cam lever 16. Rails 34 of slide 14 are located at lateral edges of slide 14 and are dimensioned to slide along tracks 30 as slide 14 moves along base 12 between the forward and retracted positions. Rails 34 comprise retention pin detents 36 that are engagable with retention pins 26 to hold slide 14 in place when slide 14 is in the retracted position.

As can be seen in FIG. 4, slide 14 includes detent 38 (shown in more detail in FIG. 6B) passing through slide 14. Cam lever 16 is insertable into and removable from slide 14 at detent 38. Detent 38 is dimensioned to allow only a portion of cam lever 16 to pass through slide 14 and into base 14.

Cam lever 16 includes a head portion 42 and a tail portion 44. Tail portion 44 of cam lever 16 extends from head portion 42 at an angle. This orientation of tail portion 44 relative to head portion 42 allows cam lever 16 to provide a cam action to move slide 14 along base 12. When universal slide assembly 10 is installed into an injection molding or die casting apparatus, cam lever 16 is directly attached to a fixed-die half of the apparatus (not shown) at head 42. Thus, when the movable-die half is separated from the fixed-die half, cam lever 16 is pulled out of base 12 and slide 14.

Face plate 24 is attached to slide 14 at front end 20 by face plate bolt 40 and is exposed to molding core C when universal slide assembly 10 is in the forward position. Face plate 24 may contain mold patterns or instruments that affect the shaping of the molds, such as pin 18, described in FIGS. 1 and 2.

In operation, as cam lever 16 is inserted into slide 14 and base 12, the mold halves close for a mold or casting cycle. The angle of tail portion 44 of cam lever 16 mechanically forces slide 14 to move forward along base 12. Rails 34 move slide 14 along track 30 towards core C. This may be accomplished in a variety of manners, such as by cam action of cam lever 16 or by hydraulic power. With universal slide assembly 10, slide 14 may solely be operated by the mechanical cam action of cam lever 16. The force applied to slide 14 forces retention pin detents 36 of slide 14 to disengage from retention pins 26, allowing slide 14 to move forward along base 12 towards core C. When universal slide assembly 10 and face plate 24 are in the forward position, plastic or metal is injected into core C of die half D. After the injected material has cured or solidified, slide 14 retracts; pulling face plate 24 away from the molding or casting. This results in a design within the molding or casting. Because face plate 24 is attached to front end 20 of slide 14, as slide 14 retracts along base 12, face plate 24 pulls away from molding core C, allowing the mold to be released.

As cam lever 16 is pulled from base 12 and slide 14, the angle of tail portion 44 of cam lever 16 mechanically forces slide 14 to retract along base 12. Rails 34 move slide 14 along track 30 away from core C until retention pin detents 36 engage the portion of retention pins 26 that are exposed to slide 14. This preferably prevents further retraction of slide 14 along base 12, and also prevents slide 14 from accidentally moving towards core C while the mold halves are open. As such, retention pins 26 are capable of engaging and disengaging retention pin detents 36. The use of retention pins 26 and retention pins detents 36 increase safety measures in the molding or casting system by providing additional means of retaining slide 14.

Figure 5A:
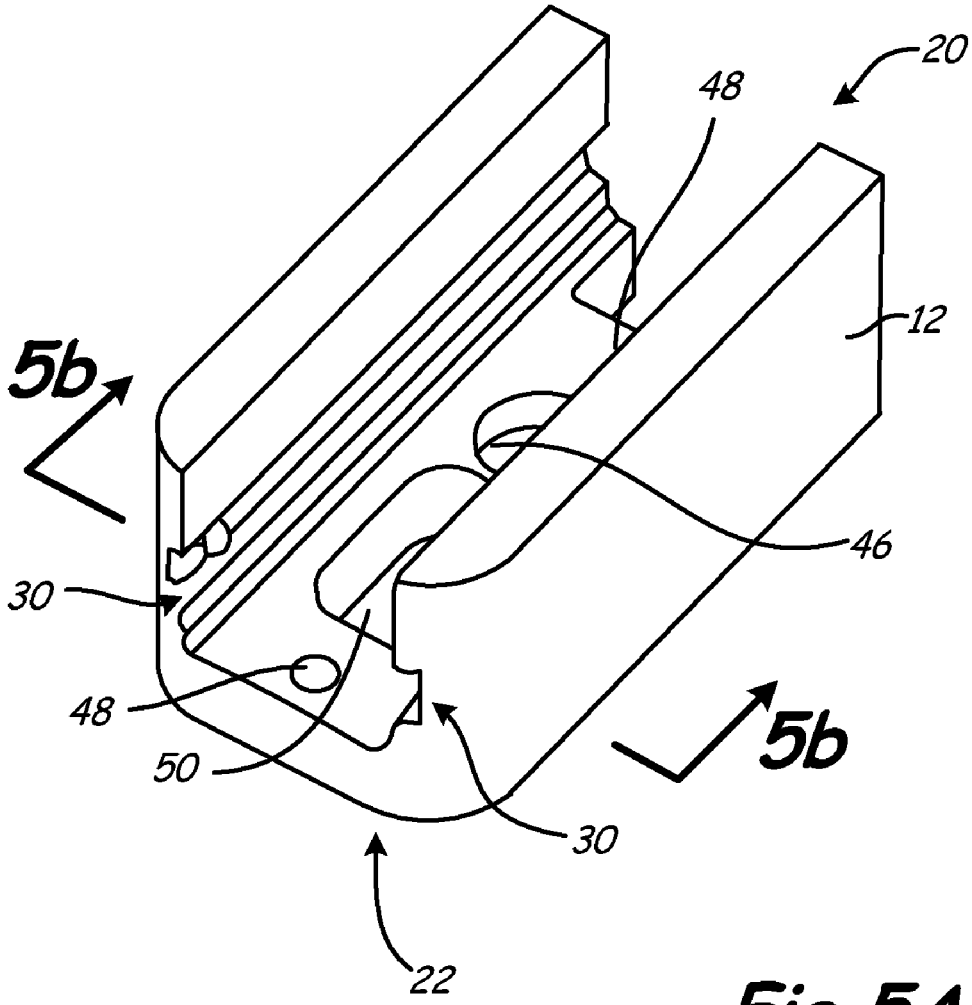
FIG. 5A is a perspective view of a base of the universal slide assembly of the present invention.

FIG. 5A is a perspective view of base 12 of universal slide assembly 10 showing mounting hole 46, threaded jack holes 48, and tail detent 50. As mentioned in FIG. 4, base 12 is mountable to die half D at mounting detent M (shown in FIGS. 1 and 2) by inserting screw 32 through mounting hole 46 in base 12. As an alternative means for mounting base 12 to mounting detent M, threaded jack holes 48 are located at each end of base 12. Screws may be inserted through die half D and into threaded jack holes 48 from beneath base 12 to mount base 12 to die half D. As such, base 12 may be mounted to die half D by screw 32 inserted through mounting hole 46 from above base 12, and/or by screws inserted through threaded jack holes 48 from beneath base 12. While FIG. 5A shows two threaded jack holes 48, the present invention is not intended to be limited to a set number of threaded jack holes 48. Additionally, when not used as mounting means, threaded jack holes 48 may be used to assist the removal of base 12 from mounting detent M by inserting tools into threaded jack holes 48 and grasping hold of base 12 to remove base 12 from mounting detent M.

After tail portion 44 of cam lever 16 (shown in FIG. 4) is passed through detent 38 of slide 14, tail portion 44 is inserted into tail detent 50 of base 12. When cam lever 16 is fully inserted through slide 14 and into base 12, tail portion 44 mechanically locks slide 14 to base 12. This prevents slide 14 from retracting relative to core C (shown in FIGS. 1 and 2) and opening molding core C while an injection molding or die casting product is being created. In one embodiment, tail portion 44 passes fully through base 12 at tail detent 50 and into mounting detent M, locking slide 14 and base 12 to mounting detent M.

Figure 5B:
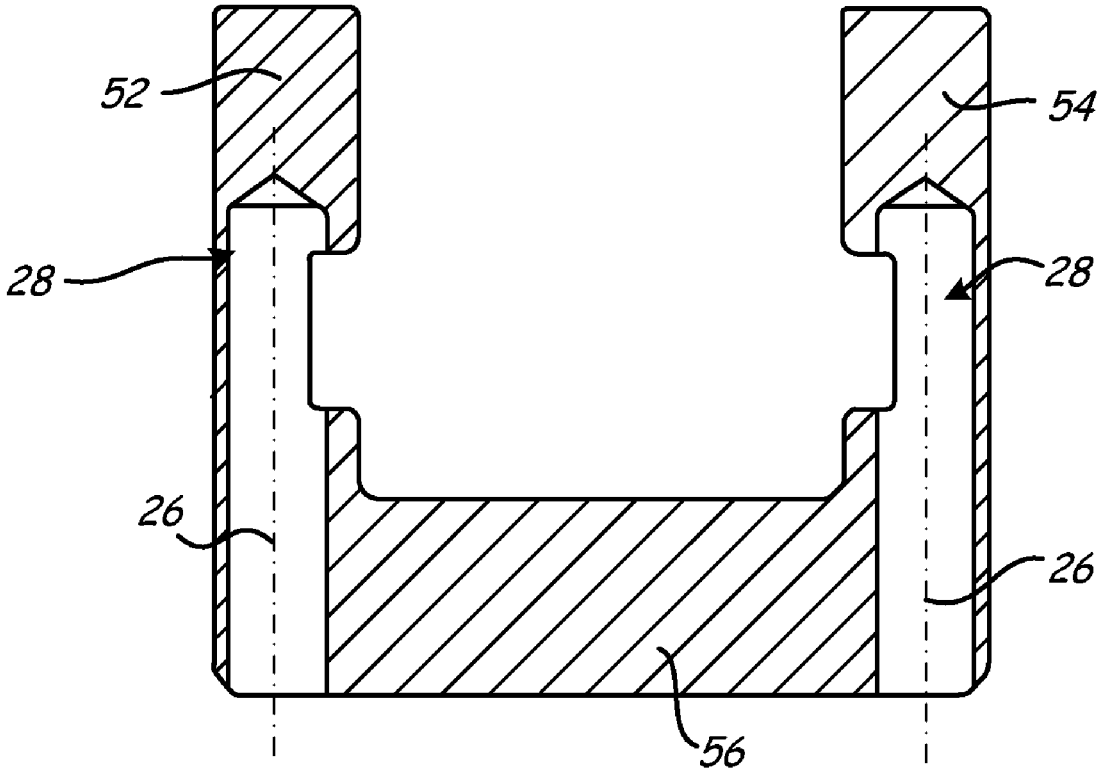
FIG. 5B is a cross-sectional view of the base of the universal slide assembly of the present invention.

FIG. 5B is a cross-sectional view of base 12 of universal slide assembly 10 along line 5*b*-5*b* in FIG. 5A. In one embodiment, base 12 is U-shaped, comprising first side wall 52, second side wall 54, and base plate 56. First and second side walls 52 and 54 are located at opposing sides of base plate 56 and are oriented normally to base plate 56 such that they face one another and are substantially parallel. Retention pinholes 28 are located in first and second side walls 52 and 54 of base 12.

Retention pin holes 28 in first and second side walls 52 and 54 have a depth and diameter sufficient to securely maintain retention pins 26. In one embodiment, retention pin holes 28 are 0.125 inches in diameter and 0.625 inches in height and extend from base plate 56 into side walls 52 and 54. Retention pins 26 are sized such that retention pins 26 are frictionally held in retention pin holes 28, as shown in FIG. 5B. In one embodiment, retention pins 26 are 0.125 inches in diameter and 0.625 inches in height. In use, retention pins 26 are engagable with slide 14 (shown in FIG. 4) at retention pin detents 36 to retain slide 14 in a retracted position.

Figure 6A:
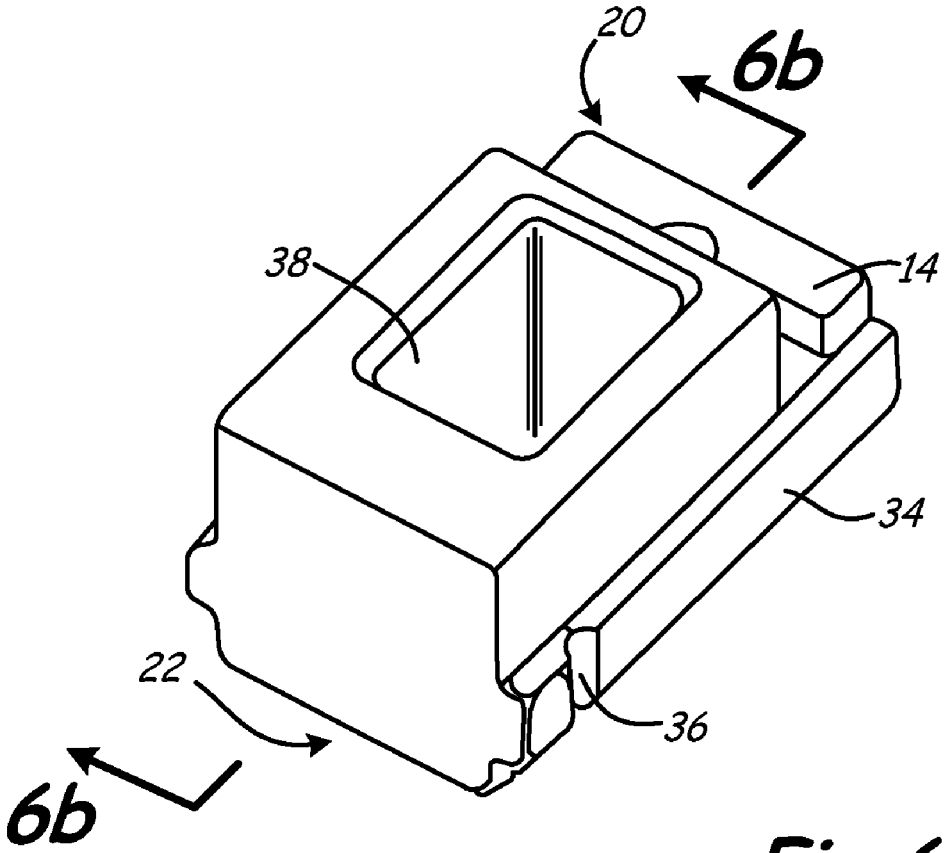
FIG. 6A is a perspective view of a slide of the universal slide assembly of the present invention.
Figure 6B:
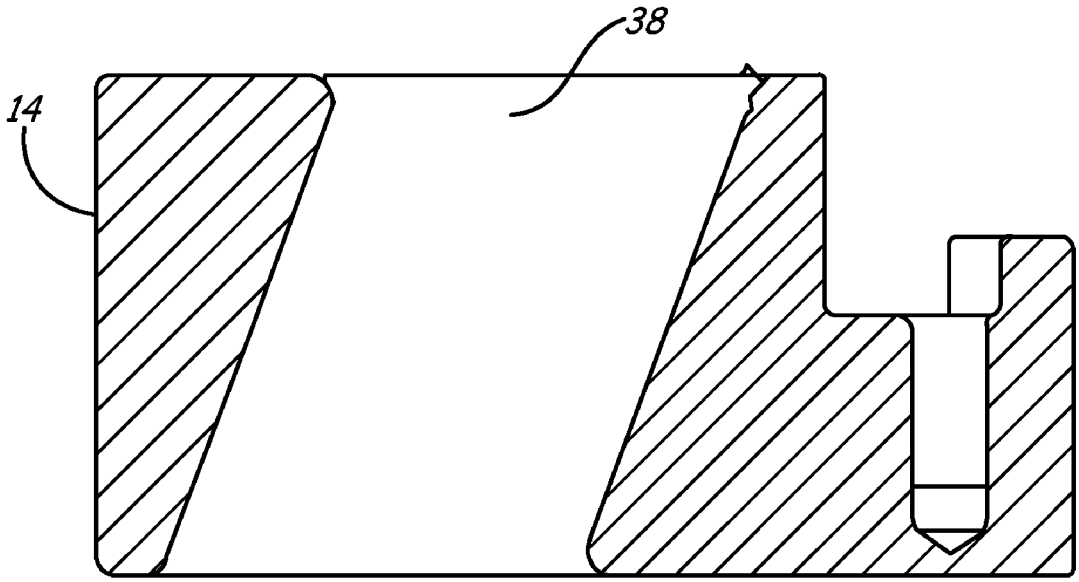
FIG. 6B is a cross-sectional view of the slide of the universal slide assembly of the present invention along line 6*b*-6*b* of FIG. 6A.

FIGS. 6A and 6B are a perspective view and a cross-sectional view of slide 14, respectively, and will be discussed in conjunction with one another. Slide 14 generally comprises rails 34, retention pin detents 36, and detent 38. Rails 34 of slide 14 move slide 14 along tracks 30 of base 12 as cam lever 16 (shown in FIG. 4) is lowered into, and pulled from, detent 38 of slide 14. As illustrated in FIG. 6B, detent 38 is channeled at an angle through slide 14. This angle corresponds to the angle of tail portion 44 of cam lever 16. When cam lever 16 is lowered into detent 38, tail portion 44 mechanically forces slide 14 to move forward along tracks 30 of base 12 towards core C of die half D (shown in FIGS. 1 and 2). Correspondingly, when cam lever 16 is pulled from detent 38, tail portion 44 mechanically forces slide 14 to retract along tracks 30 of base 12. This retractive movement pulls slide 14 away from core C of die half D.

Figure 7:
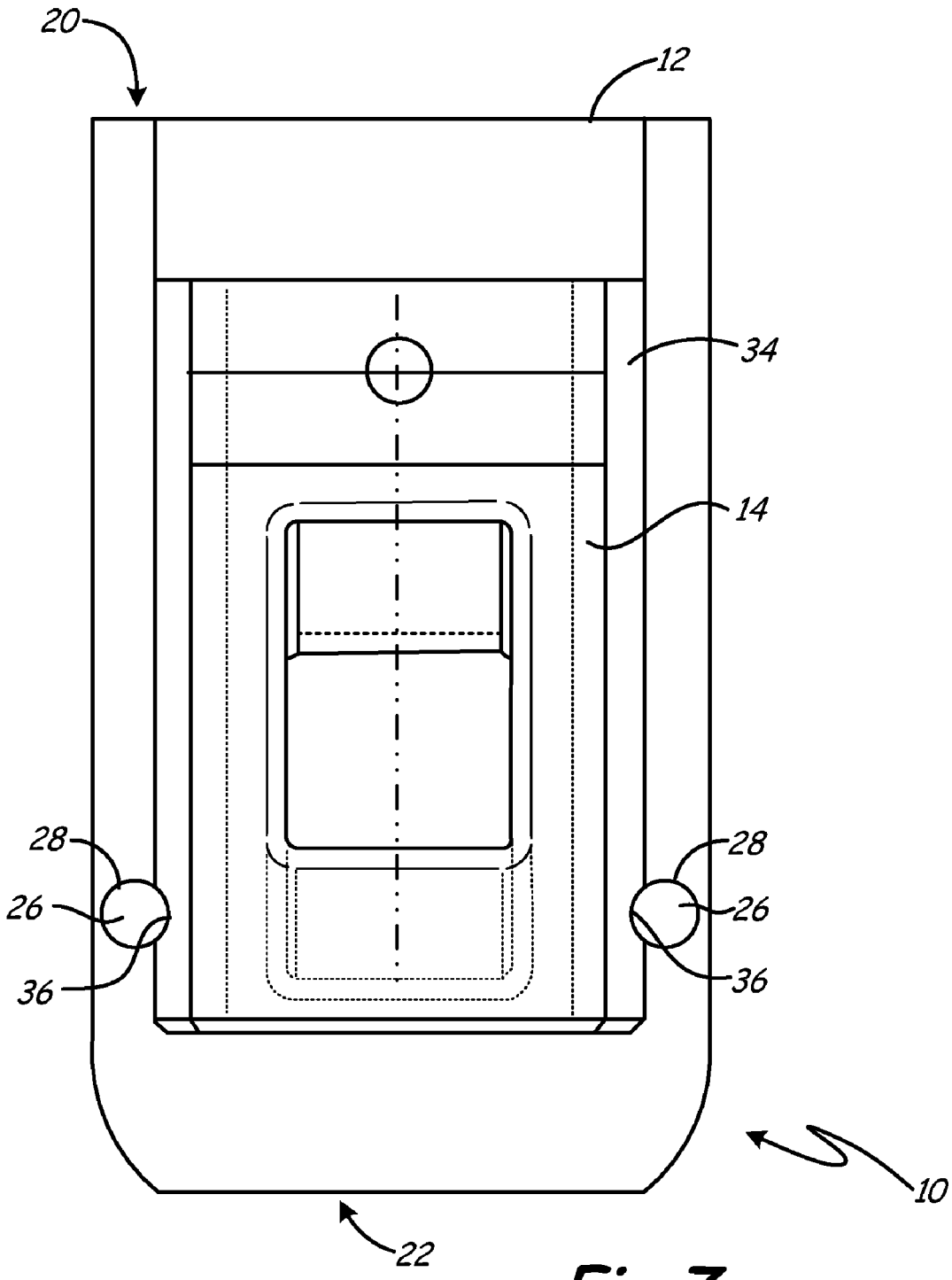
FIG. 7 is a top view of the universal slide assembly of the present invention in a retracted position.

FIG. 7 is a top view of universal slide assembly 10 in the retracted position. Base 12 comprises retention pins 26 and retention pin holes 28 and slide 14 comprises rail 34 and retention pin detents 36. When universal slide assembly 10 is in the fully retracted position, retention pins 26 engage retention pin detents 36 and retain slide 14 in base 12 in the retracted position. When enough force is applied to slide 14, either by cam action or hydraulic power, the force overcomes the tension between retention pins 26 and retention pin detents 36, allowing slide 14 to move forward along base 12. In one embodiment, retention pin detents 36 are 0.02 inches in depth.

The universal slide assembly of the present invention provides a versatile cam system for molding and casting processes. The universal slide assembly incorporates a cam lever to move a slide relative to a base. The universal slide assembly may also utilize a hydraulic system to move the slide relative to the base. This makes the universal slide assembly a diverse design. Additionally, through the use of retention pins, the slide is capable of being retained in a retracted position until the die mold closes. The universal slide assembly can be installed without requiring the slide to be individually designed or adapted to a particular movable-die half. Therefore, the universal slide assembly of the present invention is a versatile design that is cost effective, easy to install, and easy to operate with injection molding or die casting processes.

Although the present invention has been described with reference to preferred embodiments, workers skilled in the art will recognize that changes may be made in form and detail without departing from the spirit and scope of the invention.

The invention claimed is:

1. A slide assembly for use with a molding or casting process comprising:

a base mountable to a die half, the base comprising:

a generally planar base plate;

first and second opposing side walls extending generally perpendicularly from the base plate;

first and second opposing tracks extending along the first and second side walls, respectively, generally parallel to the planar base plate; and a first pin hole extending through the base plate and into the first side wall to intersect and extend across the first track;

a first stationary retention pin carried by the base and extending into the first pin hole to intersect and extend across the first track;

a slide comprising:

a slide body configured to slide between the first and second opposing walls;

first and second rails extending from the slide body and configured to slide within the first and second tracks, respectively;

a cam slot having opposing cam walls extending through the slide body at an angle; and a first retention pin detent extending across the first rail; and a cam lever comprising:

a cam head adapted to connect to a die half; and a cam tail extending from the head at an angle and configured to engage both of the cam walls of the cam slot, wherein the slide is movable relative to the base as the cam tail engages the opposing cam walls such that the first retention pin detent is adapted to engage and disengage with the first stationary retention pin for removably retaining the slide in a fixed position with respect to the base.

2. The slide assembly of claim 1, wherein the base plate and the first and second side walls form a U-shaped channel.

3. The slide assembly of claim 2, wherein a portion of the first retention pin is exposed to the slide at the first track within the U-shaped channel.

4. The slide assembly of claim 3, wherein the first retention pin detent faces the first track within the U-shaped channel.

5. The slide assembly of claim 4, wherein the portion of the first retention pin exposed to the slide is engagable with the first retention pin detent.

6. The slide assembly of claim 1, wherein the cam tail of the cam lever is further insertable through an opening in the base plate.

7. The slide assembly of claim 1 and further comprising:

a second pin hole extending through the base plate and into the second side wall to intersect the second track;

a second retention pin carried by the base and extending into the second pin hole to intersect the second track; and a second retention pin detent extending across the second rail;

wherein the second retention pin is adapted to engage the second retention pin detent.

8. The slide assembly of claim 1 wherein the first retention pin and the first pin hole have a generally circular cross section, and wherein the first pin hole intersects the first track such that a segment of a circumference of the first retention pin protrudes into the first track.

9. The slide assembly of claim 8 wherein the segment of the circumference of the first retention pin is less than one hundred eighty degrees.

10. The slide assembly of claim 8 wherein the first retention pin detent includes an arcuate surface having a profile inversely proportional to that of the segment of the circumference of the first retention pin intersecting the first track.

11. The slide assembly of claim 10 wherein the first and second rails are configured to linearly slide within the first and second tracks and the first retention pin transversely extends across the first track such that the first retention pin detent slides over the segment of the circumference of the first retention pin intersecting the first track.

12. The slide assembly of claim 1 wherein the first stationary retention pin comprises a solid, compressible cylinder that is subjected to shear stress by the first rail as the first retention pin detent disengages the first stationary retention pin.

13. The slide assembly of claim 12 wherein the retention pin hole extends through the base plate from a side opposite which the side walls extend such that the retention pin hole is parallel to a direction in which the first and second side walls extend from the base plate.

14. The slide assembly of claim 13 wherein the retention pin hole extends into the first side wall approximately perpendicular to both the base plate and a direction in which the slide is movable.

15. A slide assembly for use with a molding or casting process comprising:

a base body having a pair of side walls extending from a base plate to form a channel, the channel defining a linear direction of motion;

a first track extending along a first side wall within the channel in the linear direction of motion;

a retention pin hole extending into and through the base plate from a side opposite which the side walls extend and into the first side wall approximately perpendicular to both the direction of motion and the base plate;

a stationary retention pin carried in the retention pin hole to extend across and at least partially obstruct the first track; and a slide body insertable onto the channel, the slide comprising:

a first rail extending along the slide body in the direction of motion and configured to ride within the first track;

a lever detent extending through the slide body transverse to the direction of motion; and a retention pin detent extending across the first side wall approximately perpendicular to the direction of motion;

wherein the slide is movable relative to the channel in the direction of motion so that the retention pin detent is able to engage and disengage with the retention pin for removably retaining the slide in a fixed position along the channel.

16. The slide assembly of claim 15 wherein the retention pin comprises a solid cylindrical body having a circumference.

17. The slide assembly of claim 16 wherein the retention pin detent extends across the first rail.

18. The slide assembly of claim 17, wherein a portion of the circumference of the retention pin protrudes into the first track such that the first rail imparts shear stress into the retention pin to disengage the retention pin detent from the stationary retention pin.

19. The slide assembly of claim 18, wherein the portion of the circumference of the retention pin protruding into the first track is engagable with the retention pin detent, the retention pin detent having a profile inversely proportional to that of the portion of the circumference of the retention pin protruding into the first track.

20. The slide assembly of claim 19, and further comprising a second retention pin carried in a second retention pin hole in a second side wall of the base body, a portion of the second retention pin protruding into a second track of the second side wall and engaging a second retention pin detent of the slide.

21. A slide assembly for use with a molding or casting process comprising:

a channel having a track along a side wall to define a path of linear motion, the side wall having a retention pin hole extending perpendicular to the path of linear motion and parallel to the side wall;

a stationary retention pin carried by the retention pin hole to extend across the track; and a slide having a retention pin detent on a rail of the slide, the slide movable relative to the base along the path of linear motion, wherein the retention pin detent is adapted to engage and disengage with the retention pin for removably retaining the slide in a fixed position with respect to the channel.

22. The slide assembly of claim 21, wherein the rail of the slide engages the track of the channel.

23. The slide assembly of claim 22, wherein a portion of the retention pin is exposed to the rail of the slide at the track of the channel to impart shear stress into the retention pin.

24. The slide assembly of claim 23, wherein the portion of the retention pin exposed to the slide is engagable with the retention pin detent to relieve the shear stress.

* * * * *

UNITED STATES PATENT AND TRADEMARK OFFICE

CERTIFICATE OF CORRECTION

PATENT NO. : 7,600,445 B2
APPLICATION NO. : 11/008493
DATED : October 13, 2009
INVENTOR(S) : Richard L. Dubay It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1340 days.

Signed and Sealed this

Fifth Day of October, 2010

David J. Kappos

David J. Kappos
*Director of the United States Patent and Trademark Office*